US006869391B2

(12) United States Patent
Bächler et al.

(10) Patent No.: US 6,869,391 B2
(45) Date of Patent: Mar. 22, 2005

(54) IMPLANTED HEARING AIDS

(75) Inventors: Herbert Bächler, Meilen (CH); Christoph Hans Schmid, Zollikofen (CH); Christian Péclat, Neuchâtel (CH); Manfred Lüdi, Köniz (CH); Hans Bernhard, Liebefeld (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/932,353

(22) Filed: Aug. 17, 2001

(65) Prior Publication Data

US 2003/0036675 A1 Feb. 20, 2003

(51) Int. Cl.[7] ..... H04R 25/00
(52) U.S. Cl. ..... 600/25
(58) Field of Search ..... 600/25; 607/55, 607/56, 57; 381/23.1, 312

(56) References Cited

U.S. PATENT DOCUMENTS 4,606,329 A * 8/1986 Hough ..... 381/326
5,277,694 A 1/1994 Leysieffer
5,338,287 A * 8/1994 Miller et al. ..... 381/312
5,360,388 A * 11/1994 Spindel et al. ..... 600/25
5,800,336 A * 9/1998 Ball et al. ..... 600/25
6,084,975 A 7/2000 Perkins
2001/0055405 A1 * 12/2001 Cho ..... 381/326

FOREIGN PATENT DOCUMENTS

DE 41 04 358 A1 * 8/1992 ..... A61F/11/00
WO 97 36457 A 10/1997

* cited by examiner

*Primary Examiner*—Max F. Hindenburg
*Assistant Examiner*—Jonathan Foreman
(74) *Attorney, Agent, or Firm*—Pearne & Gordon LLP

(57) ABSTRACT

An implanted hearing aid or hearing device includes at least one permanent magnet (15) positioned in the area of the middle ear, as well as at least one coil (17), with at least one permanent magnet (15) attached to the promontory (13).

35 Claims, 1 Drawing Sheet

IMPLANTED HEARING AIDS

Figure 1:
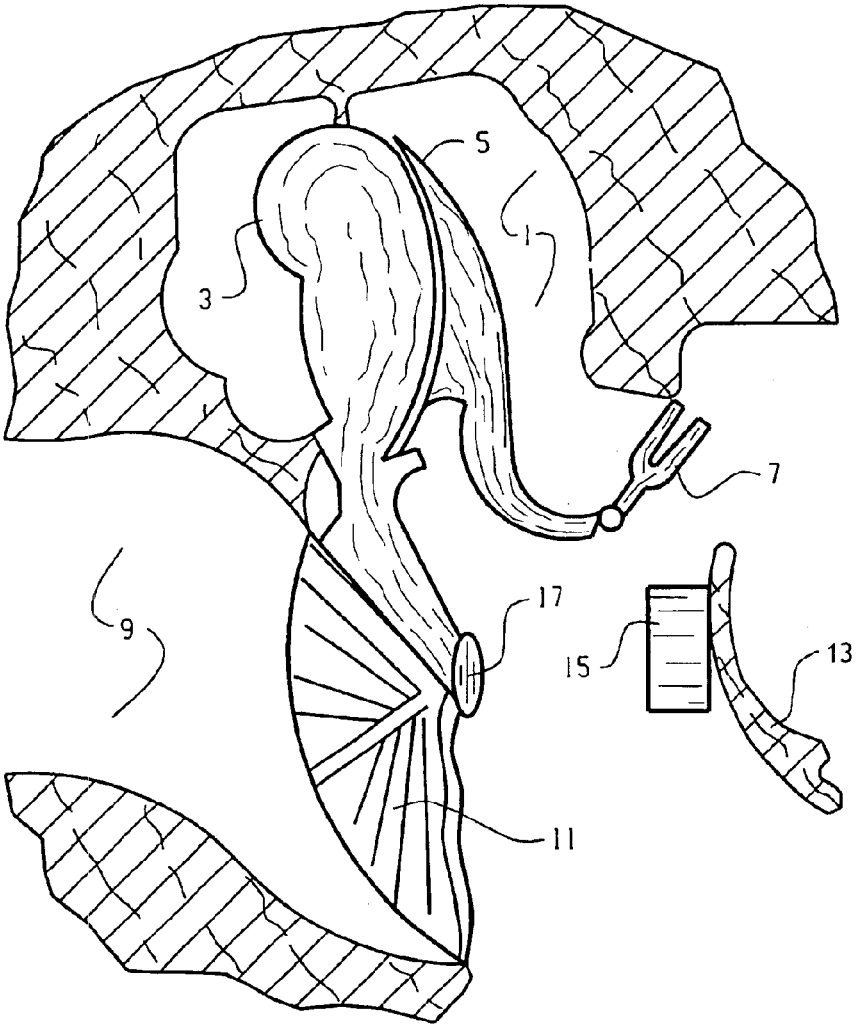

The invention relates to an implanted hearing aid, or hearing device, and to a method for auditory amplification by means of a hearing aid or device.

Earlier literature and patents describe various types of electromechanical activators for implantable hearing aids. In contrast to traditional hearing aids, the function of these middle-ear activators is to convert electrically amplified signals into mechanical vibrations and to transmit these to the auditory ossicles of the middle ear.

An implanted activator and specifically a middle-ear activator acting on the ossicle chain, when energized, should ideally produce best possible amplification of the mechanical response of the middle ear, while in its idle state the activator should interfere as little as possible with the natural movement of the ossicles.

Moreover, in certain cases of medically determined hearing impairment it is desirable for the activator to yield a high to very high amplification rate. That would correspond to a deflection of the stapes base within a range of 1 to 100 $\mu$m with force levels of up to 10 mN.

U.S. Pat. No. 5,800,336 (Ball et al, Symphonix) describes an activator which more or less meets the no-contact requirement. In its idle state, the body of that activator merely affects the natural movement of the ossicles. The effective volume of that activator is limited by the anatomy of the middle ear. The activator is therefore capable of generating only minor to moderate amplification rates in the movement of the middle ear.

U.S. Pat. No. 6,084,975 (Perkins, Resound) describes another activator which meets the no-contact requirement. It involves the attachment of a coil to the promontory and the placement of a permanent magnet on the inside of the tympanic membrane. Measurements have revealed, however, that this design does not satisfactorily meet high performance requirements. The limiting factors include low current density in the coil wires and low capacitive coupling efficiency. Given inefficient capacitive coupling plus the limited power of energy sources which a patient can carry on his body, adequate auditory self-sufficiency of the patient is hardly attainable. And inadequate capacitive coupling even poses the risk of generating a damaging level of heat in the middle ear.

In view of the situation described above, it is an objective of this invention to introduce an implanted hearing aid or hearing device design which eliminates or at least minimizes the problems mentioned.

According to the invention, this objective is achieved with a hearing aid or hearing device as discussed herein.

In contrast to U.S. Pat. No. 6,084,975, the activator per this invention is based on a design in which a relatively large permanent magnet is positioned on the promontory while a small coil is placed either behind the ear drum or in another suitable location in the ossicle chain. While U.S. Pat. No. 6,084,975 suggests positioning the permanent magnet in the area of the ear drum which puts constraints on the size of the permanent magnet, a larger permanent magnet can be advantageously placed on the promontory which is a rigid, bone-like object.

The design introduced by this invention meets the no-contact requirement and, compared to the solution proposed in U.S. Pat. No. 6,084,975, it offers an advantage in that a substantial amount of the needed magnetic flux is already provided by the permanent magnet. Consequently, smaller currents in the coil suffice to generate the necessary movement. This design concept can be reasonably expected to permit the attainment even of relatively large deflections and high force levels.

Another advantage lies in the fact that the coil can be reduced in size and that positioning the coil at the tympanic membrane assures enhanced heat dissipation through the external auditory meatus. Consequently, there is substantially less heat build-up in the middle ear than that encountered in the case of the design per U.S. Pat. No. 6,084,975.

Benchmarking has also shown that the requirement of high performance can be satisfied especially when the permanent magnet is polarized radially rather than axially.

The following implementation example will explain this invention in more detail with the aid of the attached drawing in which FIG. 1 is a schematic sectional view of the middle ear showing the hearing aid as configured according to this invention.

The middle ear 1 encompasses the ossicle chain with the malleus 3, incus 5 and stapes 7. Located between the middle ear 1 and the external auditory meatus 9 is the tympanic membrane 11. Also indicated is the promontory 13 which is a bony, rigid object.

The invention now proposes to place a permanent magnet 15 on the promontory while positioning the coil 17 either on the tympanic membrane proper or for instance on the malleus 3 next to the ear drum. The fact that the dimensions of the permanent magnet 15 can be made larger by a fair amount than those of the permanent magnet described in U.S. Pat. No. 6,084,975, correspondingly allows for a significantly small coil 17 to be employed, which offers important advantages. For one, substantially smaller currents in the coil suffice to produce the necessary movement. For another, significantly less heat is generated. Placing the coil in the area of the ear drum also permits more efficient heat dissipation through the external auditory meatus to the outside, which would be more difficult to obtain if a coil 17 were located on the promontory 13.

The drawing does not include an illustration of the power feed for the coil. Such connections could be made through the ear drum or by means of appropriate passages through the calvaria and into the area of the middle ear.

Of course, the illustration in FIG. 1 merely depicts an example of the design implementation to permit the visualization of this invention. Both the dimensions of the permanent magnet and the exact location of the permanent magnet and of the coil in the area of the promontory and, respectively, of the ear drum or ossicle tract may be varied.

Also, the geometric shape of the coil or coils and that of the permanent magnet may be modified. The simplest form of a coil is circular but it may also be oval. The same holds true for the magnet which would typically be round but may equally well be oval, square or rectangular.

The surface within the coil may extend parallel to the outer surface of the magnet, but it could possibly extend perpendicular to the magnet or at any given angle of between 0 and 180° relative to the magnet.

Finally, both the coil and the magnet may be attached in some other way. Typically, a magnet would be solidly attached to the promontory. However, it may also be made removable which would have its advantages if modifications are needed. The magnet may even be positionally adjustable, the advantage of which would be that the air gap between the coil and the magnet could still be modified after the implantation.

What is claimed is:

1. A method for enhancing auditory capacity by amplifying a natural movement of a vibrating ossicle tract, said method comprising the steps of:

converting an acoustic signal into an electrical signal; and converting said electrical signal into a mechanical oscillation of a coil positioned in a middle ear, wherein said converting said electrical signal into said mechanical oscillation of said coil utilizes a permanent magnet separate from said coil solidly attached on a promontory.

2. The method of claim 1, wherein said coil is adapted for placing in an area of an ossicle chain.

3. The method of claim 1, wherein said coil is adapted for placing at the tympanic membrane.

4. The method of claim 1, wherein said coil is placed behind a tympanic membrane.

5. A method for enhancing auditory capacity, comprising the steps of:

converting an acoustic signal into an electrical signal; and converting said electrical signal into a mechanical oscillation of a coil positioned in a middle ear by utilizing a permanent magnet, separate from said coil, solely attached to a promontory.

6. The method of claim 5, wherein said coil is positioned behind a tympanic membrane.

7. The method of claim 5, wherein said coil is positioned at a tympanic membrane.

8. The method of claim 5, wherein said coil is positioned in an area of an ossicle chain.

9. The method of claim 5, wherein said permanent magnet is removeably attached to the promontory.

10. The method of claim 5, wherein said permanent magnet is attached on the promontory in an adjustable fashion.

11. The method of claim 10, wherein an air-gap between said permanent magnet and said coil can be adjusted by post-implantation adjustment of said magnet.

12. A method for enhancing auditory capacity, comprising the steps of:

placing a coil in the area of a component of the middle ear;

attaching a magnet, separate from said coil, solely to a promontory; and converting an electrical signal into a mechanical oscillation of said coil, wherein said mechanical oscillation is transmitted to said component of the middle ear.

13. The method of claim 12, wherein said coil is placed behind a tympanic membrane.

14. The method of claim 12, wherein said coil is placed at a tympanic membrane.

15. The method of claim 12, wherein said coil is placed in an area of an ossicle chain.

16. The method of claim 12, wherein said permanent magnet is removeably attached to the promontory.

17. The method of claim 12, wherein said permanent magnet is attached on the promontory in an adjustable fashion.

18. The method of claim 17, wherein an air-gap between said permanent magnet and said coil can be adjusted by post-implantation adjustment of said magnet.

19. A method for enhancing auditory capacity, comprising the steps of:

placing a coil in the area of a component of the middle ear;

solidly attaching a magnet, separate from said coil, on a promontory; and converting an electrical signal into a mechanical oscillation of said coil, thereby providing said mechanical oscillation to said component of the middle ear.

20. The method of claim 19, wherein said coil is placed behind a tympanic membrane.

21. The method of claim 19, wherein said coil is placed at a tympanic membrane.

22. The method of claim 19, wherein said coil is placed in an area of an ossicle chain.

23. The method of claim 19, wherein said permanent magnet is attached on the promontory in an adjustable fashion.

24. The method of claim 23, wherein an air-gap between said permanent magnet and said coil can be adjusted by post-implantation adjustment of said magnet.

25. A method for enhancing auditory capacity, comprising the steps of:

attaching a coil to a component of the middle ear;

attaching a magnet, separate from said coil, on a promontory, such that said magnet is solely attached to said promontory; and converting an electrical signal into a mechanical oscillation of said coil for providing said mechanical oscillation to said component of the middle ear.

26. The method of claim 25, wherein said coil is placed behind a tympanic membrane.

27. The method of claim 25, wherein said coil is placed at a tympanic membrane.

28. The method of claim 25, wherein said coil is placed an area of an ossicle chain.

29. The method of claim 25, wherein said permanent magnet is removeably attached to the promontory.

30. The method of claim 25, wherein said permanent magnet is attached on the promontory in an adjustable fashion.

31. The method of claim 30, wherein an air-gap between said permanent magnet and said coil can be adjusted by post-implantation adjustment of said magnet.

32. A method for enhancing auditory capacity, comprising:

providing an implantable hearing device comprising at least one permanent magnet solidly attached on a promontory in the area of the middle ear; and at least one coil, separate from said permanent magnet, adapted for placing in the area of the middle ear; converting an acoustic signal into an electrical signal; and converting said electrical signal into a mechanical oscillation of said coil.

33. A method for enhancing auditory capacity, comprising:

providing an implantable hearing device comprising at least one permanent magnet solidly adjustably attached on a promontory in the area of the middle ear; and at least one coil, separate from said permanent magnet, adapted for placing in the area of the middle ear; converting an acoustic signal into an electrical signal; and converting said electrical signal into a mechanical oscillation of said coil.

34. A method for enhancing auditory capacity, comprising:

providing an implantable hearing device comprising at least one permanent magnet solidly attached on a promontory, in an adjustable.fashion, in the area of the middle ear; and at least one coil, separate from said permanent magnet, adapted for placing in the area of the middle ear; wherein an air-gap between said permanent magnet and said coil can be adjusted by post-implantation adjustment of said magnet; converting an acoustic signal into an electrical signal; and converting said electrical signal into a mechanical oscillation of said coil.

35. A method for enhancing auditory capacity, comprising the steps of:

attaching a coil to an eardrum or to a component of the ossicle tract;

solidly attaching a magnet, separate from said coil, solely on a promontory, such that said magnet is attached to said promontory in an adjustable fashion; and converting an electrical signal into a mechanical oscillation of said coil to transmit said oscillation to said eardrum or to said component of said ossicle tract.

* * * * *

UNITED STATES PATENT AND TRADEMARK OFFICE

CERTIFICATE OF CORRECTION

PATENT NO. : 6,869,391 B2
DATED : March 22, 2005
INVENTOR(S) : Herbert Bächler et al.

It is certified that error appears in the above-identified patent and that said Letters Patent is hereby corrected as shown below:

Column 4,
Line 14, after "said coil is placed", please insert -- in --.

Signed and Sealed this

Twenty-eighth Day of June, 2005

JON W. DUDAS
*Director of the United States Patent and Trademark Office*